US008522900B2

(12) United States Patent
Bellin

(10) Patent No.: US 8,522,900 B2
(45) Date of Patent: Sep. 3, 2013

(54) HIGH TOUGHNESS THERMALLY STABLE POLYCRYSTALLINE DIAMOND

(75) Inventor: Federico Bellin, Pau (FR)

(73) Assignee: Varel Europe S.A.S., Pau (FR)

( * ) Notice: Subject to any disclaimer, the term of this patent is extended or adjusted under 35 U.S.C. 154(b) by 320 days.

(21) Appl. No.: 12/884,446

(22) Filed: Sep. 17, 2010

(65) Prior Publication Data

US 2012/0067652 A1 Mar. 22, 2012

(51) Int. Cl.
*E21B 10/567* (2006.01)
*B22F 7/00* (2006.01)

(52) U.S. Cl.
USPC ..... 175/434; 219/121.72; 51/307; 51/309; 419/5

(58) Field of Classification Search
USPC ..... 175/428, 434, 432; 219/121.72; 51/307, 309; 419/5
See application file for complete search history.

(56) References Cited

U.S. PATENT DOCUMENTS

| | | | | |
|---|---|---|---|---|
| 3,745,623 | A | 7/1973 | Wentorf, Jr. et al. | |
| 4,518,659 | A | 5/1985 | Gigl et al. | |
| 4,533,004 | A * | 8/1985 | Ecer | 175/430 |
| 4,556,403 | A | 12/1985 | Almond et al. | |
| 4,604,106 | A * | 8/1986 | Hall | 51/293 |
| 4,664,705 | A | 5/1987 | Horton et al. | |
| 4,798,026 | A | 1/1989 | Cerceau | |
| 4,874,398 | A | 10/1989 | Ringwood | |
| 4,907,377 | A | 3/1990 | Csillag et al. | |
| 4,948,388 | A | 8/1990 | Ringwood | |
| 4,985,051 | A | 1/1991 | Ringwood | |
| 5,011,514 | A | 4/1991 | Cho et al. | |
| 5,151,107 | A | 9/1992 | Cho et al. | |
| 5,266,236 | A | 11/1993 | Bovenkerk | |
| 5,912,217 | A | 6/1999 | Sumiya et al. | |
| 6,915,866 | B2 * | 7/2005 | Middlemiss | 175/374 |
| 7,473,287 | B2 * | 1/2009 | Belnap et al. | 51/307 |
| 7,753,143 | B1 * | 7/2010 | Miess et al. | 175/374 |
| 7,998,573 | B2 * | 8/2011 | Qian et al. | 428/325 |
| 8,067,323 | B2 * | 11/2011 | McHale et al. | 501/96.4 |
| 8,069,935 | B1 * | 12/2011 | Miess et al. | 175/374 |
| 8,168,115 | B2 * | 5/2012 | Qian et al. | 264/642 |
| 8,231,698 | B2 * | 7/2012 | De Leeuw-Morrison et al. | 51/309 |
| 8,267,204 | B2 * | 9/2012 | Lyons | 175/432 |

(Continued)

OTHER PUBLICATIONS

Masao Wakatsuki, New Catalyst for Synthesis of Diamond, Japanese Journal of Applied Physics, Feb. 12, 1966, vol. 5, p. 337, Toshiba Central Research Laboratory, Kawasaki, Japan.

(Continued)

*Primary Examiner* — Jennifer H Gay
(74) *Attorney, Agent, or Firm* — King & Spalding LLP

(57) ABSTRACT

A mixture for fabricating a cutting table, the cutting table, and a method of fabricating the cutting table. The mixture includes a cutting table powder and a binder. The binder includes at least one carbide formed from an element selected from at least one of Groups IV, V, and VI of the Periodic Table. The carbide is in its non-stoichiometric and/or stoichiometric form. The binder can include the metal element itself. The binder can also include a catalyst. The cutting table is formed by sintering the mixture using a solid phase sintering process or a near solid phase sintering process. When forming or coupling the cutting table to a substrate, a divider is positioned and coupled therebetween to ensure that the sintering process that forms the cutting table occurs using the solid phase sintering process or the near solid phase sintering process.

20 Claims, 3 Drawing Sheets

(56) References Cited

U.S. PATENT DOCUMENTS

| | | | | |
|---|---|---|---|---|
| 8,276,691 | B2 * | 10/2012 | Qian et al. | 175/425 |
| 2005/0050801 | A1 * | 3/2005 | Cho et al. | 51/293 |
| 2007/0079994 | A1 | 4/2007 | Middlemiss | |
| 2007/0187155 | A1 | 8/2007 | Middlemiss | |
| 2008/0073126 | A1 * | 3/2008 | Shen et al. | 175/434 |
| 2008/0085407 | A1 | 4/2008 | Cooley et al. | |
| 2008/0206576 | A1 | 8/2008 | Qian et al. | |
| 2009/0114454 | A1 | 5/2009 | Belnap et al. | |
| 2009/0260299 | A1 * | 10/2009 | Liu et al. | 51/309 |
| 2010/0287845 | A1 * | 11/2010 | Montross et al. | 51/307 |
| 2011/0174550 | A1 | 7/2011 | Colin et al. | |
| 2011/0192652 | A1 * | 8/2011 | Shen et al. | 175/428 |
| 2011/0209414 | A1 * | 9/2011 | Pakalapati et al. | 51/309 |
| 2012/0055717 | A1 * | 3/2012 | Liversage et al. | 175/428 |
| 2012/0067652 | A1 * | 3/2012 | Bellin | 175/434 |
| 2012/0181090 | A1 * | 7/2012 | Qian et al. | 175/428 |

OTHER PUBLICATIONS

Howard Katzman and W. F. Libby, Sintered Diamond Compacts With A Cobalt Binder, Science, Jun. 11, 1971, pp. 1132-1133, vol. 172.

H. Kanda, K. Suzuki, O. Fukunaga, and N. Setaka, Growth of Polycrystalline Diamond, Journal of Materials Science, 1976, pp. 2336-2338, vol. 11, Chapman and Hall Ltd., Great Britain.

Y. Notsu, T. Nakajima, and N. Kawai, Sintering of Diamond With Cobalt, Materials Research Bulletin, 1977, pp. 1079-1085, vol. 12, Pergamon Press, Inc., United States.

K. Nassau and J. Nassau, The History And Present Status of Synthetic Diamond, Journal of Crystal Growth, 1979, pp. 157-171, vol. 46, North-Holland Publishing Company.

R. H. Wentorf, R. C. Devries, and F. P. Bundy, Sintered Superhard Materials, Science, May 23, 1980, pp. 872-880, vol. 208, American Association for the Advancement of Science.

Minoru Akaishi, Hisao Kanda, Yoichiro Sato, Nobuo Setaka, Toshikazu Ohsawa, Osamu Fukunaga, Sintering Behaviour Of The Diamond—Cobalt System At High Temperature And Pressure, Journal of Materials Science, 1982, pp. 193-198, vol. 17, Chapman and Hall Ltd.

Shin Tajima, Hideaki Itoh and Sigeharu Naka, Effects of Added Diamond Powder On The Reaction Sintering Behaviour Of Diamond In The Graphite-Nickel System, Journal of Materials Science, 1989, pp. 849-853, vol. 24, Chapman and Hall Ltd.

Shigeharu Naka, Hideaki Itoh, and Toshinari Tsutsui, Reaction Sintering Of Diamond Using A Binary Solvent-Catalyst Of The Fe-Ti System, Joumal of Materials Science, 1987, pp. 1753-1757, vol. 22, Chapman and Hall Ltd.

Hideaki Itoh, Shin Tajima, Masanori Tamaki, and Shigeharu Naka, Effects Of Starting Carbon And Solvent-Catalyst On The Reaction Sintering Of Diamond, Journal of Materials Science, 1988, pp. 2877-2881, vol. 23, Chapman and Hall Ltd.

Minoru Akaishi, Shinobu Yamaoka, Junzo Tanaka and Toshikazu Ohsawa, Synthesis of Sintered Diamond With A High Electrical Resistivity And High Hardness, Materials Science And Engineering, 1988, pp. 517-523, A105/106, Elsevier Sequoia, The Netherlands.

Shang-Jie Li, Minoru Akaishi, Toshikazu Ohsawa and Shinobu Yamaoka, Sintered Behaviour Of The Diamond-Super Invar Alloy System At High Temperature And Pressure, Journal of Materials Science, 1990, pp. 4150-4156, vol. 25, Chapman and Hall Ltd.

Shi-Ming Hong, Minoru Akaishi and Shinobu Yamaoka, High-Pressure Synthesis Of Heat-Resistant Diamond Composite Using A Diamond-TiC0.6 Powder Mixture, Journal of the American Ceramic Society, 1999, pp. 2497-2501, vol. 82 No. 9.

Kiminori Sato, Drastic Effect Of Mo On Diamond Nucleation In The System Of MgCO3-CaCO3-Graphite at 7.7 GPa, Journal of Crystal Growth, 2000, pp. 623-628, vol. 210, Elsevier Science B.V., The Netherlands.

E.A. Ekimov, V.A Sidorov, N.N. Mel'Nik, S. Gierlotka, and A. Presz, Synthesis of Ploycrystalline Diamond In The Boron Carbide-Graphite And Boron-Graphite Systems Under High Pressure And Temperature, Journal Of Materials Science, 2004, pp. 4957-4960, vol. 39, Kluwer Academic Publishers.

E.A. Ekimov, A.S. Ivanov, A.F. Pal, A.N. Ryabinkin, A.O. Serov, A.N. Starostin, V.E. Fortov, R.A. Sadykov, N.N. Mel'Nik and A. Presh, Behavior Of The System Of Diamond Particles, With Nanometer Nickel Coating At High Pressures And Temperatures In The Sintering Process, Doklady Physics, 2005, pp. 351-354, vol. 50 No. 7, Pleiades Publishing, Inc.

W.Q. Liu, H.A. Ma, Q.G. Han, M.H. Hu, R. Li, M.F. Zeng, X. Jia, The Character of FeMn-1# Powder Catalyst And Its Influence On The Synthesis Of Diamond, Journal of Crystal Growth, 2009, pp. 3310-3313, vol. 311, Elsevier B. V.

* cited by examiner

HIGH TOUGHNESS THERMALLY STABLE POLYCRYSTALLINE DIAMOND

TECHNICAL FIELD

The present invention relates generally to polycrystalline diamond compact ("PDC") cutters; and more particularly, to PDC cutters having improved thermal stability and toughness.

BACKGROUND

Polycrystalline diamond compacts ("PDC") have been used in industrial applications, including rock drilling applications and metal machining applications. Such compacts have demonstrated advantages, such as better wear resistance and impact resistance, over some other types of cutting elements. Many different PDC grades have been developed trying to achieve at the same time the best wear abrasion and impact resistance. The PDC can be formed by sintering individual diamond particles together under the high pressure and high temperature ("HPHT") conditions referred to as the "diamond stable region," which is typically above forty kilobars and between 1,200 degrees Celsius and 2,000 degrees Celsius, in the presence of a catalyst/solvent which promotes diamond-diamond bonding. Some examples of catalyst/solvents typically used for sintering diamond compacts are cobalt, nickel, iron, and other Group VIII metals. PDCs usually have a diamond content greater than seventy percent by volume, with about eighty percent to about ninety-five percent being typical. An unbacked PDC can be mechanically bonded to a tool (not shown), according to one example. Alternatively, the PDC can be bonded to a substrate, thereby forming a PDC cutter, which is typically insertable within a downhole tool (not shown), such as a drill bit or a reamer.

FIG. 1 shows a side view of a PDC cutter 100 having a polycrystalline diamond ("PCD") cutting table 110, or compact, in accordance with the prior art. Although a PCD cutting table 110 is described in the exemplary embodiment, other types of cutting tables, including cubic boron nitride ("CBN") compacts, are used in alternative types of cutters. Referring to FIG. 1, the PDC cutter 100 typically includes the PCD cutting table 110 and a substrate 150 that is coupled to the PCD cutting table 110. The PCD cutting table 110 is about one hundred thousandths of an inch (2.5 millimeters) thick; however, the thickness is variable depending upon the application in which the PCD cutting table 110 is to be used.

The substrate 150 includes a top surface 152, a bottom surface 154, and a substrate outer wall 156 that extends from the circumference of the top surface 152 to the circumference of the bottom surface 154. The PCD cutting table 110 includes a cutting surface 112, an opposing surface 114, and a PCD cutting table outer wall 116 that extends from the circumference of the cutting surface 112 to the circumference of the opposing surface 114. The opposing surface 114 of the PCD cutting table 110 is coupled to the top surface 152 of the substrate 150. Typically, the PCD cutting table 110 is coupled to the substrate 150 using a high pressure and high temperature ("HPHT") press. However, other methods known to people having ordinary skill in the art can be used to couple the PCD cutting table 110 to the substrate 150. In one embodiment, upon coupling the PCD cutting table 110 to the substrate 150, the cutting surface 112 of the PCD cutting table 110 is substantially parallel to the substrate's bottom surface 154. Additionally, the PDC cutter 100 has been illustrated as having a right circular cylindrical shape; however, the PDC cutter 100 is shaped into other geometric or non-geometric shapes in other embodiments. In certain embodiments, the opposing surface 114 and the top surface 152 are substantially planar; however, the opposing surface 114 and the top surface 152 can be non-planar in other embodiments. Additionally, according to some exemplary embodiments, a bevel (not shown) is formed around at least the circumference of the PCD cutting table 110.

According to one example, the PDC cutter 100 is formed by independently forming the PCD cutting table 110 and the substrate 150, and thereafter bonding the PCD cutting table 110 to the substrate 150. Alternatively, the substrate 150 is initially formed and the PCD cutting table 110 is then formed on the top surface 152 of the substrate 150 by placing polycrystalline diamond powder onto the top surface 152 and subjecting the polycrystalline diamond powder and the substrate 150 to a high temperature and high pressure process. Alternatively, the substrate 150 and the PCD cutting table 110 are formed and bonded together at about the same time. Although a few methods of forming the PDC cutter 100 have been briefly mentioned, other methods known to people having ordinary skill in the art can be used.

According to a typical example for forming the PDC cutter 100, the PCD cutting table 110 is formed and bonded to the substrate 150 by subjecting a layer of diamond powder and a mixture of tungsten carbide and cobalt powders to HPHT conditions within a press. The HPHT conditions are typically at pressures equal to or greater than fifty-five kilobars and temperatures equal to or greater than 1300 degrees Celsius. The cobalt is typically mixed with tungsten carbide and positioned where the substrate 150 is to be formed. The diamond powder is placed on top of the cobalt and tungsten carbide mixture and positioned where the PCD cutting table 110 is to be formed. The entire powder mixture is then subjected to the HPHT conditions within the press so that the cobalt liquefies and facilitates the cementing, or binding, of the tungsten carbide to form the substrate 150. The liquefied cobalt also diffuses, or infiltrates, from the substrate 150 into the diamond powder and acts as a catalyst for synthesizing diamonds and forming the PCD cutting table 110. During the sintering process of the diamond powder, the carbon from the diamond powder dissolves into the liquefied cobalt and subsequently re-precipitates to create the diamond to diamond bonding, which then forms the PCD cutting table 110. The cobalt acts as both a binder for cementing the tungsten carbide and as a catalyst/solvent for the sintering of the diamond powder to form diamond-diamond bonds. The cobalt also facilitates in forming strong bonds between the PCD cutting table 110 and the cemented tungsten carbide substrate 150. This traditional process where the catalyst/solvent, for example, cobalt, is liquefied and the diamond powder is then sintered entirely with liquefied catalyst/solvent is defined as a liquid phase pressure assisted sintering process. Within the press, the catalyst/solvent is in the liquid phase for about sixty percent of the time or greater.

Cobalt has been a preferred constituent of the PDC manufacturing process. Traditional PDC manufacturing processes use cobalt as the binder material for forming the substrate 150 and also as the catalyst material for diamond synthesis because of the large body of knowledge related to using cobalt in these processes. The synergy between the large bodies of knowledge and the needs of the process have led to using cobalt as both the binder material and the catalyst material. However, as is known in the art, alternative metals, such as iron, nickel, chromium, manganese, and tantalum, can be used as a catalyst for diamond synthesis. When using these alternative metals as a catalyst for diamond synthesis to form the PCD cutting table 110, the conventional diamond sintering process still occurs entirely once the catalyst is liquefied.

FIG. 2 is a schematic microstructural view of the PCD cutting table 110 of FIG. 1 in accordance with the prior art. Referring to FIGS. 1 and 2, the PCD cutting table 110 has diamond particles 210, one or more interstitial spaces 212 formed between the diamond particles 210, and cobalt 214 deposited within the interstitial spaces 212. During the sintering process, the interstitial spaces 212, or voids, are formed between the carbon-carbon bonds and are located between the diamond particles 210. The diffusion of cobalt 214 into the diamond powder results in cobalt 214 being deposited within these interstitial spaces 212 that are formed within the PCD cutting table 110 during the sintering process. The cobalt 214 deposited within the interstitial spaces 212 has a eutectic composition or near-eutectic composition.

Once the PCD cutting table 110 is formed, the PCD cutting table 110 is known to wear quickly when the temperature reaches a critical temperature. This critical temperature is about 750 degrees Celsius and is reached when the PCD cutting table 110 is cutting rock formations or other hard materials. The high rate of wear is believed to be caused by the differences in the thermal expansion rate between the diamond particles 210 and the cobalt 214 and also by the chemical reaction, or graphitization, that occurs between cobalt 214 and the diamond particles 210. The coefficient of thermal expansion for the diamond particles 210 is about $1.0\times10^{-6}$ millimeters$^{-1}\times$Kelvin$^{-1}$ ("mm$^{-1}$K$^{-1}$"), while the coefficient of thermal expansion for the cobalt 214 is about $13.0\times10^{-6}$ mm$^{-1}$K$^{-1}$. Thus, the cobalt 214 expands much faster than the diamond particles 210 at temperatures above this critical temperature, thereby making the bonds between the diamond particles 210 unstable. The PCD cutting table 110 becomes thermally degraded at temperatures above about 750 degrees Celsius and its cutting efficiency deteriorates significantly.

Efforts have been made to slow the wear of the PCD cutting table 110 at these high temperatures. These efforts include performing an acid leaching process of the PCD cutting table 110 which removes the cobalt 214 from the interstitial spaces 212. Typical leaching processes involve the presence of an acid solution (not shown) which reacts with the cobalt 214 that is deposited within the interstitial spaces 212 of the PCD cutting table 110. According to one example of a typical leaching process, the PDC cutter 100 is placed within an acid solution such that at least a portion of the PCD cutting table 110 is submerged within the acid solution. The acid solution reacts with the cobalt 214 along the outer surfaces of the PCD cutting table 110. The acid solution slowly moves inwardly within the interior of the PCD cutting table 110 and continues to react with the cobalt 214. However, as the acid solution moves further inwards, the reaction byproducts become increasingly more difficult to remove; and hence, the rate of leaching slows down considerably. For this reason, a tradeoff occurs between leaching process duration, wherein costs increase as the leaching process duration increases, and the leaching depth. Thus, the leaching depth is typically about 0.2 millimeter, but can be more or less depending upon the PCD cutting table 110 requirements and/or the cost constraints. The removal of cobalt 214 alleviates the issues created due to the differences in the thermal expansion rate between the diamond particles 210 and the cobalt 214 and due to graphitization. However, the leaching process is costly and also has other deleterious effects on the PCD cutting table 110, such as loss of strength. Efforts within the industry are ongoing to develop improved thermally stable polycrystalline diamond that has improved toughness characteristics.

BRIEF DESCRIPTION OF THE DRAWINGS

The foregoing and other features and aspects of the invention are best understood with reference to the following description of certain exemplary embodiments, when read in conjunction with the accompanying drawings, wherein.

Figure 1:
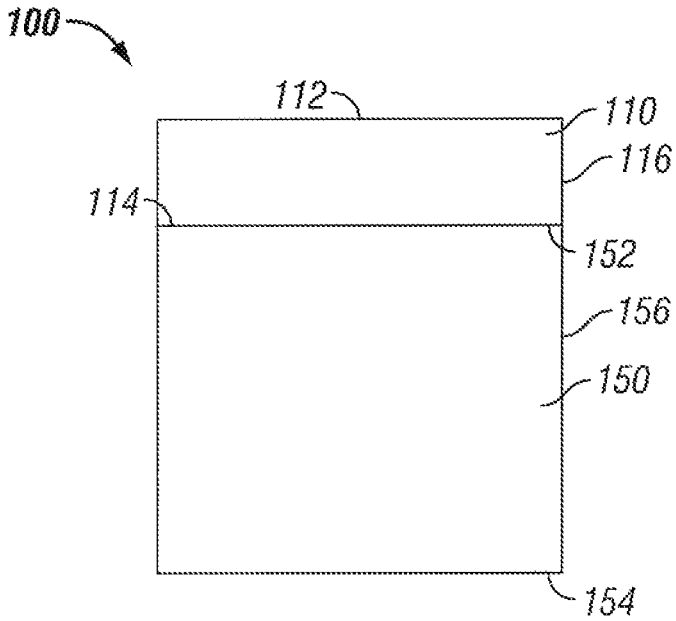
FIG. 1 (Prior Art)
FIG. 1 shows a side view of a PDC cutter having a PCD cutting table in accordance with the prior art.
Figure 2:
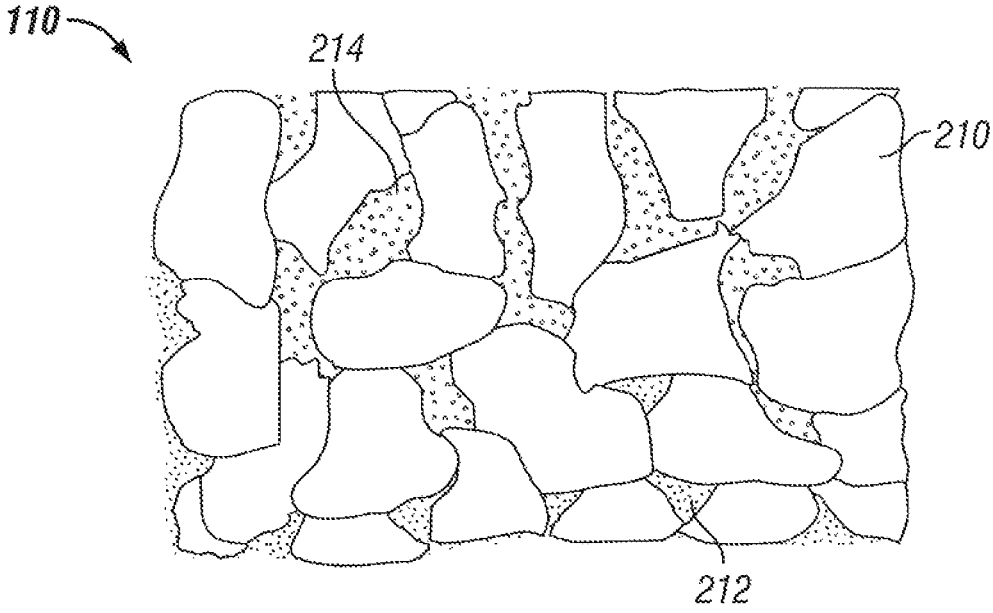
FIG. 2 (Prior Art)
FIG. 2 is a schematic microstructural view of the PCD cutting table of FIG. 1 in accordance with the prior art.

The drawings illustrate only exemplary embodiments of the invention and are therefore not to be considered limiting of its scope, as the invention may admit to other equally effective embodiments.

BRIEF DESCRIPTION OF EXEMPLARY EMBODIMENTS

The present invention is directed generally to polycrystalline diamond compact ("PDC") cutters; and more particularly, to PDC cutters having improved thermal stability and hardness. Although the description of exemplary embodiments is provided below in conjunction with a PDC cutter and/or a PCD cutting table, alternate embodiments of the invention may be applicable to other types of cutters or compacts including, but not limited to, polycrystalline boron nitride ("PCBN") cutters or PCBN compacts. As previously mentioned, the compact is mountable to a substrate to form a cutter or is mountable directly to a tool for performing cutting processes. The invention is better understood by reading the following description of non-limiting, exemplary embodiments with reference to the attached drawings, wherein like parts of each of the figures are identified by like reference characters, and which are briefly described as follows.

Figure 3A:
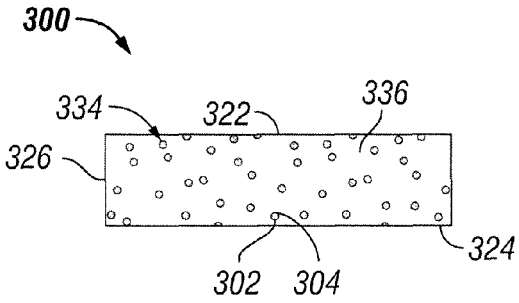
FIG. 3A is a side view of a pre-sintered PCD cutting table in accordance with an exemplary embodiment of the present invention.
Figure 3B:
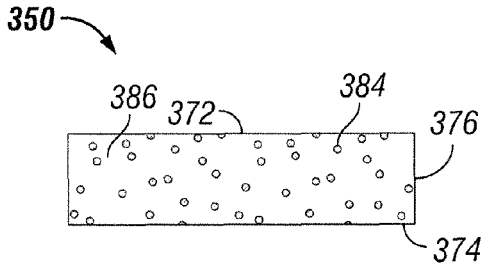
FIG. 3B is a side view of a PCD cutting table formed from sintering the pre-sintered PCD cutting table of FIG. 3A in accordance with an exemplary embodiment of the present invention.

FIG. 3A is a side view of a pre-sintered PCD cutting table 300 in accordance with an exemplary embodiment of the present invention. FIG. 3B is a side view of a PCD cutting table 350 formed from sintering the pre-sintered PCD cutting table 300 of FIG. 3A in accordance with an exemplary embodiment of the present invention. FIGS. 3A and 3B provide one example for forming the PCD cutting table 350. Referring to FIGS. 3A and 3B, the pre-sintered PCD cutting table 300 includes a cutting layer surface 322, an opposing layer surface 324, and a PCD cutting table layer outer wall 326 that extends from the circumference of the cutting layer surface 322 to the circumference of the opposing layer surface 324. The pre-sintered PCD cutting table 300 is fabricated using a diamond powder 336 and a binder material 334.

The binder material 334 is premixed with the diamond powder 336 and forms the shape of the pre-sintered PCD cutting table 300, which eventually forms the PCD cutting table 350. Although diamond powder 336 is used in some of the exemplary embodiments, other powder types, such as CBN powder or other known suitable powders, are usable in other exemplary embodiments without departing from the scope and spirit of the exemplary embodiment.

The binder material 334 includes at least one carbide 302 of an element belonging to at least one of Groups IV, V, and VI of the Periodic Table. Group IV of the Periodic Table includes elements of Titanium (Ti), Zirconium (Zr), Hafnium (Hf), and Ununquadium (Unq). Group V of the Periodic Table includes elements of Vanadium (V), Niobium (Nb), Tantalum (Ta), and Ununpentium (Unp). Group VI of the Periodic Table includes elements of Chromium (Cr), Molybdenum (Mo), Tungsten (W), and Ununhexium (Unh). According to some exemplary embodiments, the carbide 302 includes a carbide of a single element from Groups IV, V, and VI. According to alternative exemplary embodiments, the carbide 302 includes carbides of two or more elements from Groups IV, V, and VI.

According to some exemplary embodiments, the carbide 302 is in its non-stoichiometric form, for example, molybdenum carbide ($Mo_2C_x$) and titanium carbide ($TiC_x$) where x is less than one. In alternative exemplary embodiments, however, the carbide 302 is in its stoichiometric form, for example, molybdenum carbide ($Mo_2C$) and titanium carbide (TiC). In some exemplary embodiments, the carbide 302 includes a combination of carbides that are in their stoichiometric form and their non-stoichiometric form. In some exemplary embodiments where at least a portion of the carbide 302 is in its stoichiometric form, the binder material 334 also includes small quantities of metals 304 belonging to Group IV, V, and VI of the Periodic Table that are used in forming the carbide 302. Adding small quantities of metal 304 to the binder material 334 when the carbide 302 includes carbides in their stoichiometric form creates an imbalance between metal atoms and carbon atoms, which thereby facilitates the diffusion process between the metal 304 and the carbon. The binder material 334 is a homogenized mixture when more than one component forms the binder material 334.

The average particle size of the binder material 334 is in the nanometer range, or at least in the submicron range, which thereby increases the chemical reactivity of the binder material 334 and enhances the diamond sintering process. In certain exemplary embodiments, the binder material 334 includes diamond powder 336 to help the uniform mixing of the carbide 302 and the metal 304. The diamond powder 336 used in the binder material 334 has an average particle size that is in the submicron range.

According to yet other exemplary embodiments, the binder material 334 includes small quantities of catalyst metal (not shown) which includes, but is not limited to, cobalt, nickel, iron, and/or other catalyst materials known to people having ordinary skill in the art. The catalyst metal facilitates the sintering process and also behaves as a toughening agent. The catalyst metal occupies a volumetric percentage that is about one percent or less of the volume of the binder material 334. In some exemplary embodiments, the catalyst metal occupies a volumetric percentage that is about one-half percent or less of the volume of the binder material 334. However, the catalyst metal can occupy a volumetric percentage that is as much as about ten percent or less of the volume of the binder material 334 according to alternative exemplary embodiments.

One example of the components included in the binder material 334 are ninety-five percent by volume of titanium carbide and five percent by volume of titanium. Another example of the components included in the binder material 334 are forty percent by volume of tungsten carbide, fifty percent by volume of molybdenum carbide, five percent by volume of tungsten, and five percent by volume of molybdenum. In certain exemplary embodiments, one or more of the tungsten carbide and the molybdenum carbide include the carbides in their stoichiometric form and their non-stoichiometric forms, for example, $WC/W_2C$ and $Mo_2C/MoC$. In some examples, small quantities of either or both of diamond powder and catalyst metal are included within the binder material 334.

Once the binder material 334 is prepared and homogeneously mixed, the binder material 334 is mixed with different cuts of diamond powder 336 to form the pre-sintered PCD cutting table 300. The diamond powder 336 occupies a volumetric percentage of about seventy percent or more, while the binder material 334 occupies a volumetric percentage of about thirty percent or less. In some exemplary embodiments, the diamond powder 336 occupies a volumetric percentage ranging from about eighty-five percent to about ninety-five percent, while the binder material 334 occupies a volumetric percentage ranging from about five percent to about fifteen percent. In certain exemplary embodiments, the diamond powder 336 undergoes a powder cleaning process that is known to people having ordinary skill in the art. The pre-sintered PCD cutting table 300 is treated in an HPHT system, or press, which delivers the proper amount of pressure and temperature for the diamond sintering process. The delivered pressure is about seventy kilobars or greater, and the temperature is about 1600 degrees Celsius or greater. However, in other exemplary embodiments, the delivered pressure is about sixty kilobars or greater, and the temperature is about 1500 degrees Celsius or greater.

According to some exemplary embodiments, the diamond sintering process occurs entirely in the solid phase, which is referred to as a solid phase sintering process. In some exemplary embodiments, however, a transient liquid phase is formed during a small time portion of the sintering process, but is then transformed entirely into the solid phase where the sintering process continues. When a transient liquid phase is formed during the sintering process, the process is referred to as a near solid phase sintering process. The transient liquid phase forms about 0.1 percent or less of the volume during the sintering process. This small time portion of the sintering process where the transient liquid phase exists is about ten percent or less of the total sintering time. In some exemplary embodiments, this small time portion of the sintering process where the transient liquid phase exists is about eight percent or less of the total sintering time. In some exemplary embodiments, this small time portion of the sintering process where the transient liquid phase exists is about six percent or less of the total sintering time. In some exemplary embodiments, this small time portion of the sintering process where the transient liquid phase exists is about four percent or less of the total sintering time. This transient liquid phase forms in some exemplary embodiments within a narrow concentration range and is due to the concentration changes occurring between the carbon and the metal during the sintering, or diffusion, process, which is explained in further detail with respect to FIGS. 4 and 5.

Once the sintering process on the pre-sintered PCD cutting table 300 is completed, the PCD cutting table 350 is formed. The PCD cutting table 350 includes a cutting surface 372, an opposing surface 374, and a PCD cutting table outer wall 376 that extends from the circumference of the cutting surface 372 to the circumference of the opposing surface 374. The PCD cutting table 350 includes a diamond lattice 386, which is formed from the diamond powder 336, and a modified binder material 384 deposited within the interstitial spaces formed within the diamond lattice 386. The modified binder material 384 is similar to the binder material 334, except that substantially all the metals have been transformed into its respective carbides. According to some exemplary embodiments, a bevel (not shown) is formed around the circumference of the PCD cutting table 350. Depending upon the exemplary embodiment, the PCD cutting table 350 is used for cutting a hard material by either using it independently, coupling a portion of the PCD cutting table 350 to a tool, or coupling the opposing surface 374 to a substrate (not shown).

Within the PCD cutting table 350, there are substantially no free metals that remain present since the metals have completely reacted with the carbon diffusing from the diamond powder. Hence, more carbides are formed within the PCD cutting table 350 until the stoichiometric composition is reached. There are no eutectic or close to eutectic catalyst metal that remains within the PCD cutting table 350, which thereby increases the thermal stability of the PCD cutting table 350.

Figure 4:
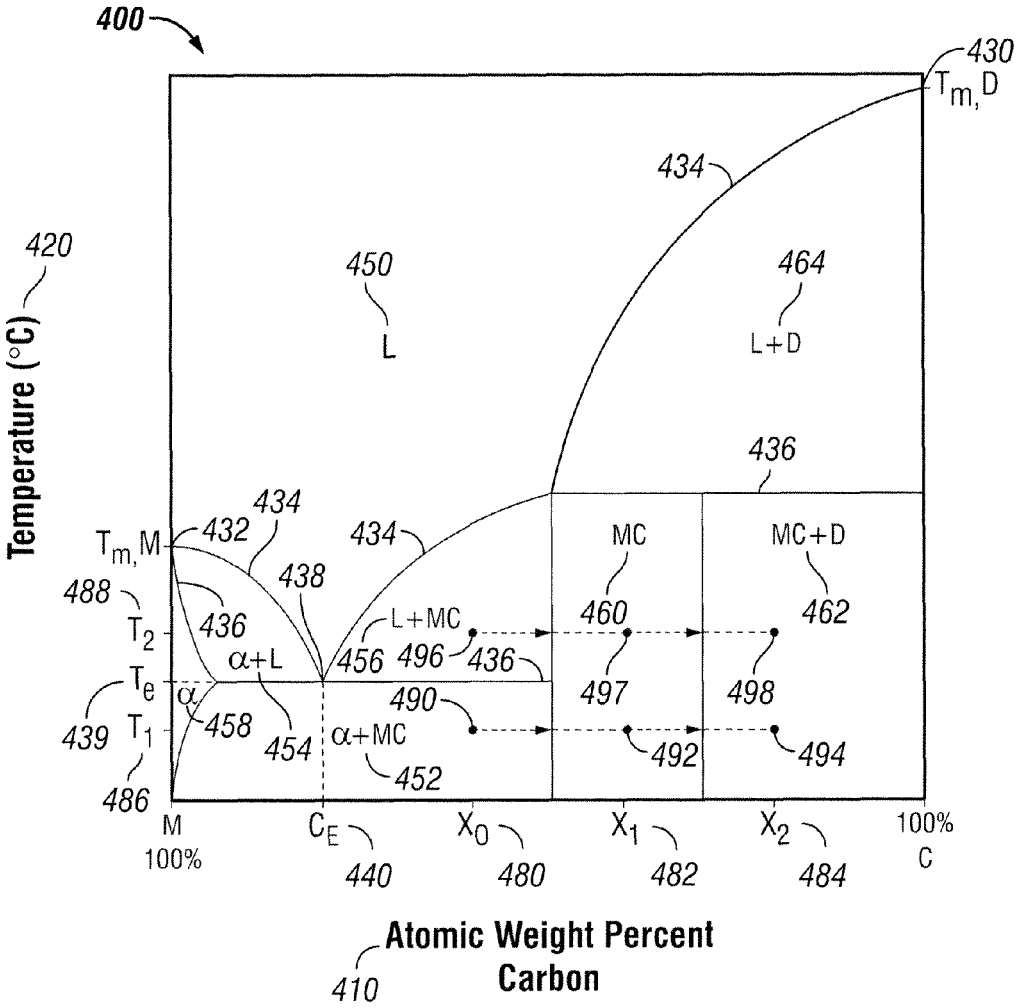
FIG. 4 is a phase diagram of carbon and Element M in accordance with an exemplary embodiment of the present invention.

FIG. 4 is a phase diagram of carbon and Element M 400 in accordance with an exemplary embodiment of the present invention. Although phase diagram of carbon and Element M 400 is provided as an example of a binary phase diagram according to one exemplary embodiment, different phase diagrams of carbon and one or more other elements, such as Titanium, Chromium, or Tungsten, can be used for illustrating the solid phase sintering process or near solid phase sintering process. Element M is a metal capable of forming a carbide. Referring to FIG. 4, the phase diagram of carbon and Element M 400 includes a composition axis 410, a temperature axis 420, a liquidus line 434, a solidus line 436, and a eutectic point 438.

The composition axis 410 is positioned on the x-axis and represents the composition of the PCD cutting table. The composition is measured in atomic weight percent of carbon. Proceeding from left to right along the composition axis 410, the percentage composition of carbon increases. Thus, at the extreme left of the composition axis 410, the material is one hundred percent Element M. Conversely, at the extreme right of the composition axis 410, the material is one hundred percent carbon, or diamond. The composition axis 410 includes a eutectic composition 440 (Ce), which is discussed in further detail below.

The temperature axis 420 is positioned on the y-axis and represents the various temperatures that can be subjected on the carbon and Element M composition. The temperature is measured in degrees Celsius. Proceeding from top to bottom along the temperature axis 420, the temperature decreases. The temperature axis 420 includes an Element M melting temperature 432, a diamond melting temperature 430, and a eutectic melting temperature 439, which is discussed in further detail below. The Element M melting temperature 432 is the temperature at which a material having one hundred percent Element M melts. The diamond melting temperature 430 is the temperature at which a material having one hundred percent diamond melts.

The phase diagram of carbon and Element M 400 provides information on different phases of the carbon and Element M compositions and under what compositions and temperatures these different phases exist. These phases include the total liquid phase 450 ("L"), the metal and metal carbide solid phase 452 ("α+MC"), a metal slurry phase 454 ("α+L"), a metal carbide slurry phase 456 ("L+MC"), a metal solid phase 458 ("α"), a metal carbide solid phase 460 ("MC"), a metal carbide and diamond solid phase 462 ("MC+D"), and a diamond slurry phase 464 ("L+D"). The total liquid phase 450 occurs when both carbon and Element M are both completely in the liquid phase. The metal and metal carbide solid phase 452 occurs when both metal carbide and Element M are both completely in the solid phase. Thus, the carbon is all bonded with the metal to form a carbide and there is no free solid carbon. The metal slurry phase 454 occurs when the material has Element M crystals that is suspended in a slurry which also includes liquid Element M. The metal carbide slurry phase 456 occurs when the material has metal carbide crystals that is suspended in a slurry which also includes liquid metal carbide. The metal solid phase 458 occurs when all the Element M is in solid phase and some solid metal carbide is mixed with the solid Element M. The metal carbide solid phase 460 occurs when all the metal carbide is in solid phase and some solid metal is mixed with the solid metal carbide. The metal carbide and diamond solid phase 462 occurs when the material has formed diamond in the solid phase and some of the metal carbide also is in the solid phase. The diamond slurry phase 464 occurs when the material has diamond crystals that is suspended in a slurry which also includes liquid carbon.

The liquidus line 434 extends from the Element M melting temperature 432 to a eutectic point 438 and then to the diamond melting temperature 430. The liquidus line 434 represents the temperature at which the composition completely melts and forms a liquid. Thus, at temperatures above the liquidus line 434, the composition is completely liquid. The solidus line 436 is positioned below the liquidus line 434, except for at the eutectic point 438. The solidus line 436 represents the temperature at which the composition begins to melt. Thus, at temperatures below the solidus line 436, the composition is completely solid for one or more compounds within the material. At the eutectic point 438, the liquidus line 434 meets with the solidus line 436. The eutectic point 438 is defined on the phase diagram 400 as the intersection of the eutectic temperature 439 and the eutectic composition 440. The eutectic composition 440 is the composition where the carbon-Element M mixture behaves as a single chemical composition and has a melting point where the total solid phase 452 turns into a total liquid phase 450 at a single temperature.

According to one example for forming the PCD cutting table 350 (FIG. 3) in a solid phase sintering process, the sintering process is performed with an initial mixture composition 480 ($X_o$). The temperature of the initial mixture composition 480 is raised to a temperature of $T_1$ 486, which forms a first mixture point 490. The initial mixture composition 480 is at the metal and metal carbide solid phase 452 when the initial mixture composition 480 is at $T_1$ 486. Hence, the metal and the metal carbides are both entirely solid. As the sintering process continues and the temperature is held relatively constant, the carbon atoms diffuse into the metal, which is Element M according to the phase diagram 400, and the metal atoms diffuse into the carbon. Each of these diffusion rates are different and result in altering the composition of the mixture during the sintering process. The composition of Element M within the mixture decreases and the composition of carbon increases according to some exemplary embodiments. Even though the temperature is maintained as substantially constant, the composition of the mixture changes from the initial mixture composition 480 to an intermediate mixture composition 482 ($X_1$). Thus, the mixture proceeds from the first mixture point 490 to a second mixture point 492, which is in the metal carbide solid phase 460. If the sintering process was allowed to continue for an infinite time duration, the mixture composition with respect to Element M would further decrease, while the mixture composition with respect to carbon would further increase. Thus, the mixture composition proceeds from the intermediate mixture composition 482 to a final mixture composition 484 ($X_2$), and the second mixture point 492 proceeds to a third mixture point 494. The third mixture point 494 is in the metal carbide and diamond solid phase 462. However, in actuality, the sintering process does not proceed for an infinite time duration and thus the final composition of the mixture after completion of the solid phase sintering process lies at a point between the intermediate mixture composition 482 and the final mixture composition 484. Thus, as seen in this exemplary embodiment, the sintering process is a solid phase sintering process where no liquid or transient liquid phase is formed. In the solid phase sintering process, the pressures within the press are typically higher than the pressures used in the prior art.

According to one example for forming the PCD cutting table 350 (FIG. 3) in a near solid phase sintering process, the sintering process also is performed with the initial mixture composition 480. However, the temperature of the initial mixture composition 480 is raised to a temperature of $T_2$ 488, which forms an initial mixture point 496. The initial mixture point 496 is in the metal carbide slurry phase 456. Thus, the initial mixture composition 480 is transformed from a solid phase into a transient liquid phase, or temporary liquid phase, during this temperature rise to $T_2$ 488. As the sintering process continues, the carbon atoms diffuse into the metal, which is Element M according to the phase diagram 400, and the metal atoms diffuse into the carbon. Each of these diffusion rates are different and result in altering the composition of the mixture during the sintering process. The composition of Element M within the mixture decreases and the composition of carbon increases according to some exemplary embodiments. Even though the temperature is maintained as substantially constant, the composition of the mixture changes from the initial mixture composition 480 to the intermediate mixture composition 482. Thus, the mixture proceeds from the initial mixture point 496 to a secondary mixture point 497, which is in the metal carbide solid phase 460. Thus the transient liquid phase disappears and the mixture is now solid. If the sintering process was allowed to continue for an infinite time duration, the mixture composition with respect to Element M would further decrease, while the mixture composition with respect to carbon would further increase. Thus, the mixture composition proceeds from the intermediate mixture composition 482 to a final mixture composition 484, and the secondary mixture point 497 proceeds to an end mixture point 498. The end mixture point 498 is in the metal carbide and diamond solid phase 462. However, in actuality, the sintering process does not proceed for an infinite time duration and thus the final composition of the mixture after completion of the near solid phase sintering process lies at a point between the intermediate mixture composition 482 and the final mixture composition 484. Thus, as seen in this exemplary embodiment, the sintering process is a near solid phase sintering process where a transient, or temporary, liquid phase is formed. In the near solid phase sintering process, the pressures within the press are typically higher than the pressures used in the prior art.

Figure 5:
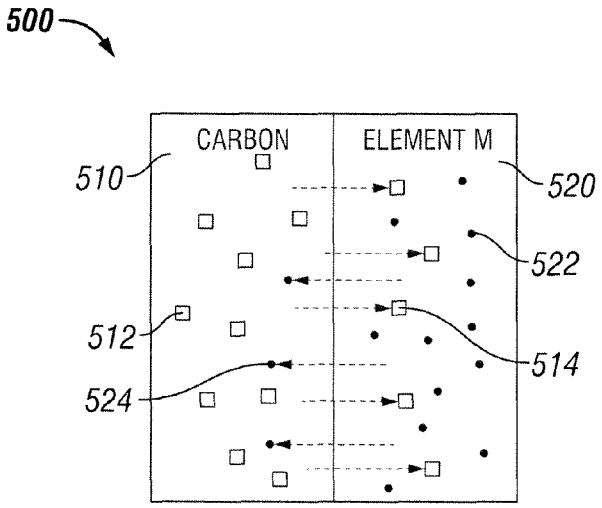
FIG. 5 is a schematic microscopic view of a diffusion process occurring between two solid elements in accordance with an exemplary embodiment of the present invention.

FIG. 5 is a schematic microscopic view of a diffusion process 500 occurring between two solid elements 510 and 520 in accordance with an exemplary embodiment of the present invention. Referring to FIG. 5, the diffusion process includes a first solid element 510 adjacent a second solid element 520. According to an exemplary embodiment, the first solid element 510 is a solid carbon; however, other solid elements can be used in lieu of the solid carbon without departing from the scope and spirit of the exemplary embodiment. The second solid element 520 is a solid Element M, which is a metal capable of forming a carbide.

The solid carbon 510 includes carbon atoms 512, which are represented in FIG. 5 as squares. The solid Element M 520 includes Element M atoms 522, which are represented in FIG. 5 as circles. During the diffusion process, some carbon atoms 512 diffuse into solid Element M 520 and turn into migrated carbon atoms 514. Similarly, during the diffusion process, some Element M atoms 522 diffuse into solid carbon 510 and turn into migrated Element M atoms 524. The rate in which Element M atoms 522 diffuse into the solid carbon 510 is different than the rate in which carbon atoms 512 diffuse into solid Element M 520 according to some exemplary embodiments. As seen in FIG. 5, there are five migrated carbon atoms 514, while there are three migrated Element M atoms 524. Thus, the composition of the mixture during the sintering process changes as previously mentioned with respect to FIGS. 3 and 4.

Figure 6A:
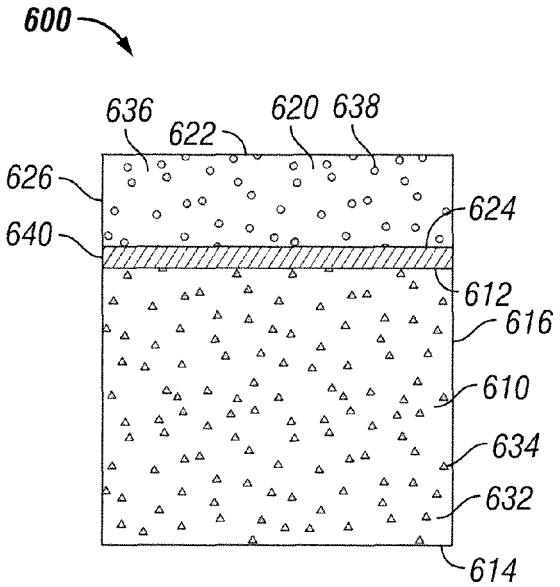
FIG. 6A is a side view of a pre-sintered PDC cutter in accordance with an exemplary embodiment of the present invention.
Figure 6B:
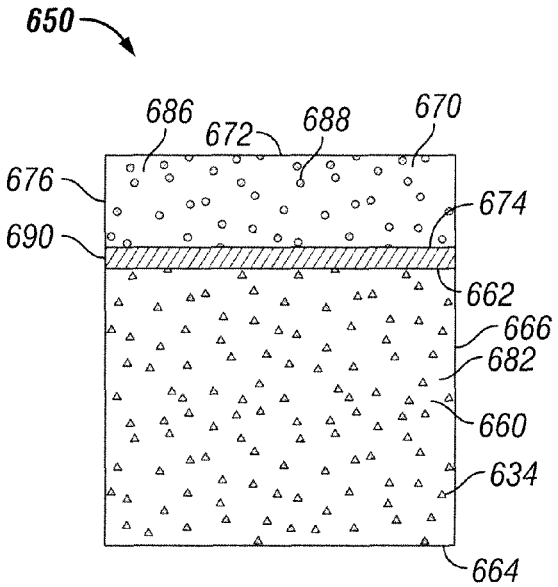
FIG. 6B is a side view of a PDC cutter formed from sintering the pre-sintered PDC cutter of FIG. 6A in accordance with an exemplary embodiment of the present invention.

FIG. 6A is a side view of a pre-sintered PDC cutter 600 in accordance with an exemplary embodiment of the present invention. FIG. 6B is a side view of a PDC cutter 650 formed from sintering the pre-sintered PDC cutter 600 of FIG. 6A in accordance with an exemplary embodiment of the present invention. FIGS. 6A and 6B provide one example for forming the PDC cutter 650. Referring to FIGS. 6A and 6B, the pre-sintered PDC cutter 600 includes a substrate layer 610, a PCD cutting table layer 620, and a metal divider 640, while the PDC cutter 650 includes a substrate 660, a PCD cutting table 670, and a divider 690. The substrate layer 610 is positioned at the bottom of the pre-sintered PDC cutter 600 and forms the substrate 660 upon completion of the sintering process. The metal divider 640 is positioned atop the substrate layer 610 and forms the divider 690 upon completion of the sintering process. The PCD cutting table layer 620 is positioned atop the metal divider 640 and forms the PCD cutting table 670 upon completion of the sintering process. Thus, the metal divider 640 is positioned between the PCD cutting table layer 620 and the substrate layer 610 and prevents components from the substrate layer 610 migrating into the PCD cutting table layer 620 during the sintering process.

The substrate layer 610 is formed from a mixture of a substrate powder 632 and a first binder material 634. The substrate powder 632 is tungsten carbide powder; however, the substrate powder 632 is formed from other suitable materials known to people having ordinary skill in the art without departing from the scope and spirit of the exemplary embodiment according to some other exemplary embodiments. The first binder material 634 is any material capable of behaving as a binder for the substrate powder 610. Some examples of the first binder material 634 include, but are not limited to, cobalt, nickel chrome, and iron. Once subjected to high pressure and high temperature conditions, the substrate layer 610 forms the substrate 660. The first binder material 634 melts and facilitates the sintering of the substrate layer 610. The substrate layer 610 includes a top layer surface 612, a bottom layer surface 614, and a substrate layer outer wall 616 that extends from the circumference of the top layer surface 612 to the circumference of the bottom layer surface 614. The first binder material 634 is interspersed within the substrate 660 after completion of the sintering process. The substrate layer 610 is formed into a right circular cylindrical shape according to one exemplary embodiment, but can be formed into other geometric or non-geometric shapes.

The PCD cutting table layer 620 is formed from a mixture of a diamond powder 636 and a second binder material 638. Although diamond powder 636 is used to form the PCD cutting table layer 620, other suitable materials known to people having ordinary skill in the art can be used without departing from the scope and spirit of the exemplary embodiment. The second binder material 638 is similar to the binder material 334 (FIG. 3A) and includes the several different exemplary embodiments that have previously been described with reference to the binder material 334 (FIG. 3A). Once subjected to high pressure and high temperature conditions, the PCD cutting table layer 620 forms the PCD cutting table 670 in a similar manner as the sintering process which occurs when transforming the pre-sintered PCD cutting table 300 (FIG. 3A) into the PCD cutting table 350 (FIG. 3B). Hence the sintering process occurring within the PCD cutting table layer 620 is a solid phase sintering process or a near solid phase sintering process, wherein a transient liquid phase is formed temporarily. The PCD cutting table layer 620 includes a cutting layer surface 622, an opposing layer surface 624, and a PCD cutting table layer outer wall 626 that extends from the circumference of the cutting layer surface 622 to the circumference of the opposing layer surface 624. According to some exemplary embodiments, a bevel (not shown) is formed around the circumference of the PCD cutting table layer 620.

The metal divider 640 is positioned between the substrate layer 610 and the PCD cutting table layer 620. The metal divider 640 is fabricated from a metal or alloy capable of bonding itself to both the PCD cutting table layer 620 and the substrate layer 610 upon completion of the sintering process. Additionally, the metal divider 640 prevents the first binder material 634 that is located within the substrate layer 610 from migrating into the PCD cutting table layer 620. The metal divider 640 allows the PCD cutting table layer 670 to be bonded indirectly to the substrate 660 thereby forming the PDC cutter 650, while ensuring that the sintering process that forms the PCD cutting table 670 occurs as a solid phase sintering process or a near solid phase sintering process. According to some exemplary embodiments, the metal divider 640 is formed from the same metals or alloys using the same metals as used within the second binder material 638. For example, if the second binder material 638 includes molybdenum and/or molybdenum carbide, the metal divider 640 also is fabricated using molybdenum or a molybdenum alloy. According to some exemplary embodiments, the metal divider 640 is a thin disc. Alternatively, the metal divider 640 is formed using conventional chemical vapor deposition (CVD) techniques, plasma vapor deposition (PVD) techniques, or any other techniques known to people having ordinary skill in the art. Although the metal divider 640 is used as one example for preventing the first binder material 634 from migrating into the PCD cutting table layer 620 during the sintering process, other methods or devices known to people having ordinary skill in the art can be used for achieving the same or similar effects without departing from the scope and spirit of the exemplary embodiments.

Once the pre-sintered PDC cutter 600 is formed, the pre-sintered PDC cutter 600 is treated in a high pressure and high temperature system, or press, which delivers the proper amount of pressure and temperature for the sintering process. The delivered pressure is about seventy kilobars or greater, and the temperature is about 1600 degrees Celsius or greater. However, in other exemplary embodiments, the delivered pressure is about sixty kilobars or greater, and the temperature is about 1500 degrees Celsius or greater.

Within the substrate layer 610, the first binder material 634 liquefies and facilitates the sintering of the substrate powder 610 to form the substrate 660. The liquefied first binder material 634 does not migrate into the PCD cutting table layer 620. Within the PCD cutting table layer 620, the diamond powder 636 is sintered with the second binder material 638. The sintering process within the PCD cutting table layer 620 occurs in the solid phase or near solid phase. The diamond powder 636 forms a diamond lattice 686 and the second binder material 638 forms a modified second binder material 688 which is deposited within interstitial spaces that are formed within the diamond lattice 686. The modified second binder material 688 is similar to the modified binder material 384 (FIG. 3B) and provides toughness and thermal stability to the PCD cutting table 670. Within the metal divider 640, the carbon atoms from the PCD cutting table layer 620 reacts with the metal within the metal divider 640 to form metal carbides, and hence form strong bonds between the divider 690 and the PCD cutting table 670. Similarly, within the metal divider 640, the carbon atoms from the substrate layer 610 reacts with the metal within the metal divider 640 to form metal carbides, and hence form strong bonds between the divider 690 and the substrate 660.

The PDC cutter 650 is formed once the substrate 660, the PCD cutting layer 670, and the divider 690 are completely formed and the divider 690 is bonded to both the substrate 660 and the PCD cutting layer 670. The substrate 660 includes a top surface 662, a bottom surface 664, and a substrate outer wall 666 that extends from the circumference of the top surface 662 to the circumference of the bottom surface 664. The substrate 660 includes cemented substrate powder 682 and the first binder material 634 interspersed therein. The substrate 660 is formed into a right circular cylindrical shape according to one exemplary embodiment, but can be formed into other geometric or non-geometric shapes depending upon the application in which the PDC cutter 650 is to be used.

The PCD cutting table 670 includes a cutting surface 672, an opposing surface 674, and a PCD cutting table outer wall 676 that extends from the circumference of the cutting surface 672 to the circumference of the opposing surface 674. The PCD cutting table 670 includes the diamond lattice 686 and the modified second binder material 688 deposited within the interstitial spaces formed within the diamond lattice 686. The modified second binder material 688 has been slightly modified when compared to the second binder material 638. The free metal within the second binder material 638, which was present before the sintering process, has reacted with carbon to form more carbides. Thus, within the PCD cutting table 670, there are substantially no free metals that remain present since the metals have completely reacted with the carbon diffusing from the diamond powder. Hence, more carbides are formed within the PCD cutting table 670 until the stoichiometric composition is reached. There are no eutectic or close to eutectic catalyst metal that remains within the PCD cutting table 670, thereby increasing the thermal stability of the PCD cutting table 670.

The divider 690 is formed from the metal divider 640 and is bonded to the opposing surface 674 of the PCD cutting table 670 and to the top surface 662 of the substrate 660. The divider 690 includes at least some metal carbides therein. According to some exemplary embodiments, the divider 690 includes metals and/or metal alloys, along with their respective carbides. According to other exemplary embodiments, the divider 690 is formed entirely from carbides.

The PCD cutting table 670 is indirectly bonded to the substrate 660 using the divider 690 according to methods known to people having ordinary skill in the art. In one example, the PDC cutter 650 is formed by independently forming the PCD cutting table 670 and the substrate 660, and thereafter placing the metal divider 640 between the PCD cutting table 670 and the substrate 660 and bonding the PCD cutting table 670 to the divider 690 and bonding the substrate 660 to the divider 690. In another example, the substrate 660 is initially formed and the metal divider 640 is placed atop the substrate 660 and the PCD cutting table layer 620 is placed atop the metal divider 640. The substrate 660, the metal divider 640, and the PCD cutting table layer 620 are then sintered under high pressure and high temperature conditions to form the PDC cutter 650.

In one exemplary embodiment, upon coupling the PCD cutting table 670 to the substrate 660, the cutting surface 672 of the PCD cutting table 670 is substantially parallel to the bottom surface 664 of the substrate 660. Additionally, the PDC cutter 650 has been illustrated as having a right circular cylindrical shape; however, the PDC cutter 650 is shaped into other geometric or non-geometric shapes in other exemplary embodiments. In certain exemplary embodiments, the opposing surface 674 and the top surface 662 are substantially planar; however, the opposing surface 674 and the top surface 662 can be non-planar in other exemplary embodiments.

Although each exemplary embodiment has been described in detail, it is to be construed that any features and modifications that are applicable to one embodiment are also applicable to the other embodiments. Furthermore, although the invention has been described with reference to specific embodiments, these descriptions are not meant to be construed in a limiting sense. Various modifications of the disclosed embodiments, as well as alternative embodiments of the invention will become apparent to persons of ordinary skill in the art upon reference to the description of the exemplary embodiments. It should be appreciated by those of ordinary skill in the art that the conception and the specific embodiments disclosed may be readily utilized as a basis for modifying or designing other structures or methods for carrying out the same purposes of the invention. It should also be realized by those of ordinary skill in the art that such equivalent constructions do not depart from the spirit and scope of the invention as set forth in the appended claims. It is therefore, contemplated that the claims will cover any such modifications or embodiments that fall within the scope of the invention.

What is claimed is:

1. A cutting table, comprising a lattice structure forming a plurality of interstitial spaces therein; and a modified binder material deposited within the interstitial spaces during a sintering process that forms the lattice structure, the modified binder material comprising at least one carbide formed from an element, the element selected from at least one of Groups IV, V, and VI, wherein the modified binder material is formed from a second binder material during the sintering process, the second binder material comprising at least one of a non-stoichiometric metal carbide or a stoichiometric metal carbide with a free metal, the metal used within the non-stoichiometric metal carbide, the stoichiometric metal carbide, and the free metal being the same as the element.

2. The cutting table of claim 1, wherein the modified binder material is substantially void of any free metals.

3. The cutting table of claim 1, wherein the lattice structure comprises a polycrystalline diamond.

4. The cutting table of claim 1, wherein the modified binder material further comprises a catalyst material.

5. The cutting table of claim 1, wherein the sintering process occurs entirely in a solid phase.

6. The cutting table of claim 5, wherein the sintering process occurs at a relatively constant temperature, the temperature being maintained below it eutectic melting temperature.

7. The cutting table of claim 1, wherein the sintering process occurs in a near solid phase, wherein a transient liquid phase is formed during the sintering process.

8. The cutting table of claim 7, wherein the sintering process occurs at a relatively constant temperature after reaching the transient liquid phase, the temperature being maintained above a eutectic melting temperature.

9. The cutting table of claim 7, wherein the transient liquid phase forms about 0.1 percent or less of the volume during the sintering process.

10. The cutting table of claim 7, wherein the transient liquid phase exists about ten percent or less of a total time of the sintering process.

11. A cutter, comprising:

a substrate comprising a top surface and a first binder material interspersed therein;

a cutting table, comprising:

a cutting surface;

an opposing surface;

a cutting table outer wall extending from the circumference of the opposing surface to the circumference of the cutting surface;

as lattice structure forming a plurality of interstitial spaces therein; and a modified second binder material deposited within the interstitial spaces during a sintering process that forms the lattice structure, the modified binder material comprising at least one carbide formed front an element, the element selected from at least one of Groups IV, V, and VI; and a divider coupled to the top surface and to the opposing surface; the divider preventing the first binder material from migrating into the cutting table during the sintering process, wherein the modified binder material is formed from a second binder material during the sintering process, the second binder material comprising at least one of a non-stoichiometric metal carbide or a stoichiometric metal carbide with a free metal, the metal used within the non-stoichiometric metal carbide, the stoichiometric metal carbide, and the free metal being the same as the element.

12. The cutter of claim 11, wherein the modified second binder material is substantially void of any free metals.

13. The cutter of claim 11, wherein the lattice structure comprises a polycrystalline diamond.

14. The cutter of claim 11, wherein the modified second binder material further comprises a catalyst material.

15. The cutter of claim 11, wherein the sintering process occurs entirely in a solid phase.

16. The cutter of claim 15, wherein the sintering process occurs at a relatively constant temperature, the temperature being maintained below a eutectic melting temperature.

17. The cutter of claim 11, wherein the sintering process occurs in a near solid phase, wherein a transient liquid phase is formed during the sintering process.

18. The cutter of claim 17, wherein the sintering process occurs at a relatively constant temperature after reaching the transient liquid phase, the temperature being maintained above a eutectic melting temperature.

19. The cutter of claim 17, wherein the transient liquid phase forms about 0.1 percent or less of the volume during the sintering process.

20. The cutter of claim 17, wherein the transient liquid phase exists about ten percent or less of a total time of the sintering process.

* * * * *